US005678958A

United States Patent [19]

Rossi

[11] Patent Number: 5,678,958

[45] Date of Patent: Oct. 21, 1997

[54] RETAINING WALL CONSISTING OF DRY MOUNTED BUILDING ELEMENTS

[76] Inventor: Jean-Louis Rossi, Le Grand Pin du Righi, 25 rue Georges Doublet, 06100 Nice, France

[21] Appl. No.: 492,062

[22] PCT Filed: Jan. 13, 1994

[86] PCT No.: PCT/FR94/00039

§ 371 Date: Jul. 20, 1995

§ 102(e) Date: Jul. 20, 1995

[87] PCT Pub. No.: WO94/17253

PCT Pub. Date: Aug. 4, 1994

[30] Foreign Application Priority Data

Jan. 22, 1993 [FR] France ..... 93 00844

[51] Int. Cl.[6] ..... E02D 29/02

[52] U.S. Cl. ..... 405/286; 52/606; 405/284; 47/83

[58] Field of Search ..... 405/286, 284, 405/285, 262; 52/606, 608, 593; 47/83

[56] References Cited

U.S. PATENT DOCUMENTS

| | | | |
|---|---|---|---|
| 4,524,551 | 6/1985 | Scheiwiller | 405/286 |
| 4,920,712 | 5/1990 | Dean | 405/286 |
| 4,964,761 | 10/1990 | Rossi | 405/286 |
| 5,154,032 | 10/1992 | Ritter | 405/284 X |
| 5,161,918 | 11/1992 | Hodel | 405/286 |

*Primary Examiner*—Dennis L. Taylor

*Attorney, Agent, or Firm*—Young & Thompson

[57] ABSTRACT

A retaining wall, wherein the lower edges of vertical walls (8) within a shell (3) are fitted with at least one coupling tab interacting with the plane upper vertical edges of the adjacent underlying shell. The vertical walls (6, 7) having any shape are also provided with at least one coupling tab. The transverse vertical wall (7) between the two building elements forming the double building element comprises a breakable portion (13) such that a decorative facing (14) is exposed on its outer surface for each building element, and said decorative facing (14) is exposed on its outer surface for each building element, and said decorative facing (14), when locally removed, reveals a surface with a "rough hewn stone" appearance.

10 Claims, 10 Drawing Sheets

RETAINING WALL CONSISTING OF DRY MOUNTED BUILDING ELEMENTS

FIELD OF THE INVENTION

The invention has for its object a retaining wall adapted to be decorated with vegetation, consisting of dry mounted construction elements, by interfitting within each other, and by superpositioning on each other, each element being of the type constituted by an open-bottom shell.

BACKGROUND OF THE INVENTION

The state of the art can be defined by the following patents:

EP-0 215 991: retaining wall adapted to be decorated with vegetation, and consisting of dry mounted construction elements interfitting within each other, and by superposition on each other, each element being of the type constituted by an open-bottom shell comprising vertical partitions characterized by the fact that a first vertical partition, parallel to the upstream wall of the shell, delimits a large space on the downstream side which serves as a flowerpot and at least one upstream space which serves as recesses for roots for the upper shell mounted rearwardly, offset upstream on the lower shell, this latter space being divided into at least two smaller spaces by a second vertical partition perpendicular to the upstream wall and to the first partition, the size of the upstream spaces is such that when the shells are superposed on each other, the roots, which leave the upper shell, can only proceed toward the ground and not into the lower shell, which is to say that the vertical partition of the upper shell registers with the upstream wall of the lower shell.

The construction element is constituted by two adjacent shells produced as a single block.

It comprises grooves on the side walls of the shell, so as to permit the shells to interfit within each other.

DE-U-7 824 776: this document describes an element for retaining constructions for embankments, natural slopes or earth works. It is formed from an open-bottom shell in the shape of a cube with a vertical partition which separates the shell into two equal recesses, said shell perpendicularly connects the upstream wall and the downstream wall. Lateral blockage of the element is ensured by two shoulders, the first shoulder is provided in the medial portion of the upper edge of the side wall to extend along the upstream wall and to terminate on the upper edge of the other side wall facing the point of departure of the first shoulder.

FR-A-2 550 812: this invention has for its object to improve the operation of a mechanical wall by various features of novelty. There should be noted for example the use if desired of more economical elements because they are technically easier to make, or else lighter, requiring less material for their fabrication and easier handling. There should also be noted the use if desired of additional elements, or of interfitting partitions, in lieu of a normal element; the saving thus realized is considerable. Another improvement relates to the adaptation to the elements of a system of lateral positional variation permitting changing as desired the inclination of the wall according to its mounting; this system permits better adaptation to the environment and infinite architectural combinations.

EP-A-0 362 110: retaining wall adapted to be decorated with vegetation, and constituted by dry mounted construction elements, interfitting within each other, and by superposition on each other, each light element being of the type constituted by an open-bottom shell comprising two external side vertical walls, and vertical partitions, a first vertical partition, parallel to the upstream wall of the shell, delimits a large space downstream which serves as a flowerpot and at least one upstream space which serves as recesses for roots for the upper shell mounted rearwardly, offset upstream on the lower shell, this latter space being divided into at least two smaller spaces by a second vertical partition perpendicular to the upstream wall and to the first partition; the size of the upstream spaces is such that when the shells are superposed on each other, the roots which leave the upper shell can only go toward the ground and not into the lower shell, which is to say that the vertical partition of the upper shell is at the upstream wall of the lower shell, characterized by the fact that the construction element is comprised by a light element and it comprises a complementary element which forms the upstream wall of said construction element and which forms beyond a notch disposed on each edge of the shell, two small spaces or recesses which permit supplemental vegetation growth; the light element and the complementary element forming a heavy element.

The complementary element which forms the upstream portion of said construction element is prolonged by a notch on each edge of the shell forming a horizontal recess; an intermediate vertical wall, in prolongation of the second vertical wall, delimits two recesses or spaces which can serve as lost form work; beyond the notch, a vertical wall, prolonging the vertical walls, forms the two small spaces or recesses.

At the lower edges, there is a forward notch and another large notch in the medial portion of the open-bottom block.

The success of retaining walls permits users to make greater and greater use thereof. Thus, the walls are higher, the pressures and loads greater.

Present construction elements greatly limit the height of the applications.

It is difficult to change the angle of the wall with the construction elements, which is why the first construction elements are disposed with a large angle in the case in which the supporting wall is high.

Finally, these supporting walls are made with dry mounted construction elements filled with dirt or partially with concrete; these elements can also be decorated with vegetation.

SUMMARY OF THE INVENTION

The invention permits solving all these problems, the doubling of the coupling elements permits changing the angle of the supporting wall.

Their production permits reducing the cost of manufacture by producing two elements connected by a common vertical transverse wall. This heavy element permits constructing heavy walls without interconnecting openings and having a monolithic assembly of high strength.

The decorative facings and the surfaces produced in the "rough-hewn stone" manner permit obtaining new external esthetic effects.

The retaining wall adapted to be decorated with vegetation, and constituted by dry mounted construction elements, by interfitting the elements within each other, and by superposition on each other, each element being of the parallelepipedal type constituted by an open-bottom shell comprising two parallel external lateral vertical walls interconnected at each of their ends by a vertical wall of any shape, said shell is provided internally with several vertical walls which delimit spaces of different shapes and sizes, the external lateral walls are provided with recesses so as to permit the elements to interfit within each other.

Within the shell, delimited by parallel external vertical walls and vertical walls of any shape, the lower edges of the internal vertical walls are provided with at least one coupling tab which coacts with the vertical upper edges of the lower adjacent shell which themselves are flat.

The vertical walls of any shape which connect the parallel external lateral vertical walls are provided with at least one coupling tab.

The construction element is double and is formed by two construction elements interconnected by a single transverse vertical partition.

The vertical walls of any shape, which connect the two parallel external lateral vertical walls, are outwardly oriented from the double construction element.

The transverse vertical partition, common to the two construction elements forming the double construction element, comprises a divisible portion.

The transverse vertical partition, common to the two elements, once divided, exposes on its external surface for each construction element, a decorative facing.

The decorative facing is ground off at certain of the broken points to give the appearance of a "rough-hewn stone" surface.

The vertical partitions of any shape, which connect the two parallel external lateral vertical walls, give the appearance on their external surface of a decorative facing.

The decorative facing is ground off at certain broken points to give the appearance of a "rough-hewn stone" surface.

The transverse vertical partition forms a vertical plane of symmetry for the double construction element.

The distance between two coupling tabs carried by the lower edges corresponds to the thickness of an internal vertical wall, and the distance between two internal vertical walls corresponds to the distance between the two opposite surfaces of the two adjacent coupling tabs such that there exists a plurality of possible positions between two adjacent superposed elements.

BRIEF DESCRIPTION OF THE INVENTION

The accompanying drawings are given by way of example and are not limiting. They show a preferred embodiment according to the invention. They permit easy comprehension of the invention.

It shows the removal from the external surface of the decorative facing which leaves a "rough-hewn stone" surface.

Figure 6:
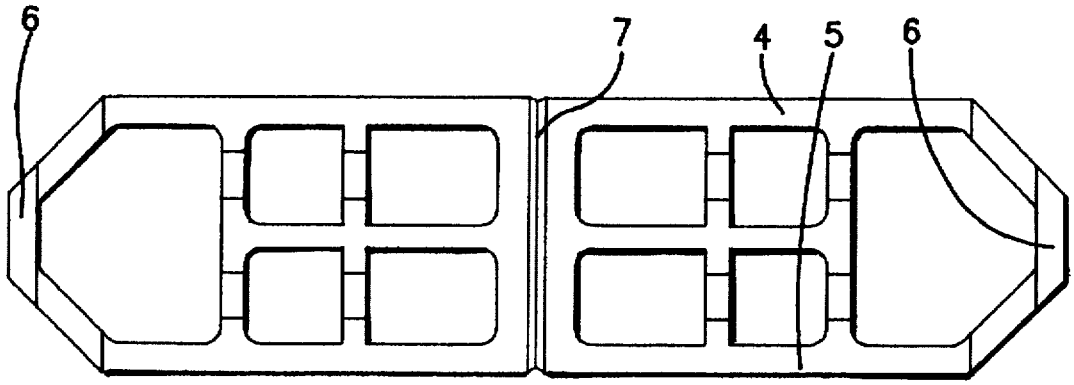

FIG. 6 is a plan view of a "double" construction element, seen from above.

Figure 7:
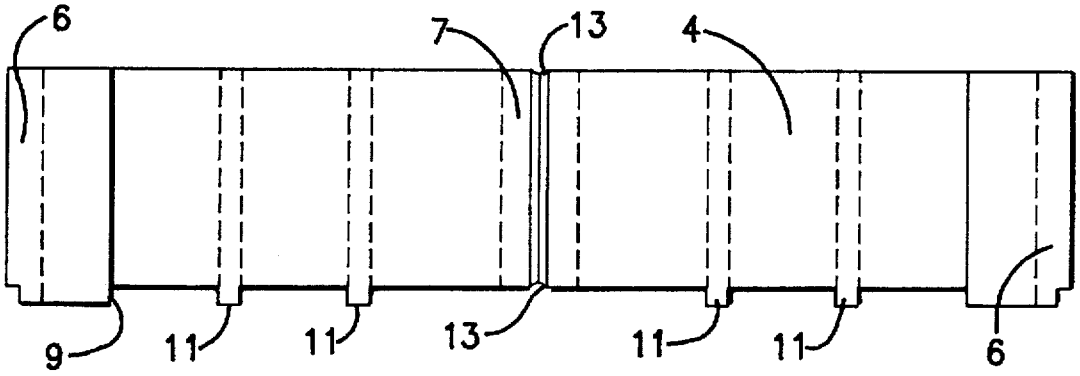

FIG. 7 is a view like FIG. 6, but from the side along the longitudinal axis.

Figure 8:
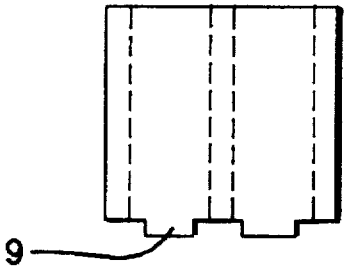

FIG. 8 is a view like FIG. 6, but from the side along the transverse axis.

Figure 9:
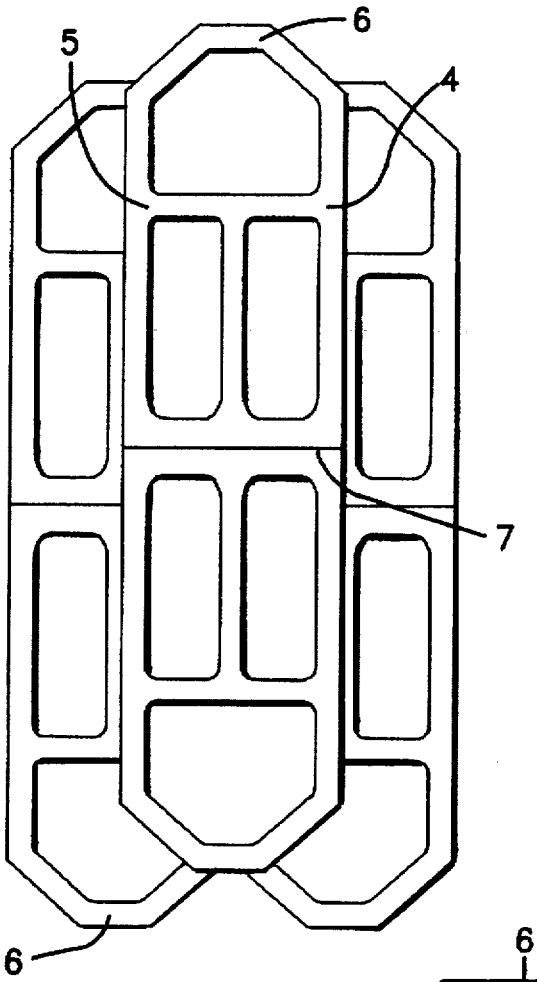

FIG. 9 is a view of several construction elements assembled one above the other.

Figure 10:
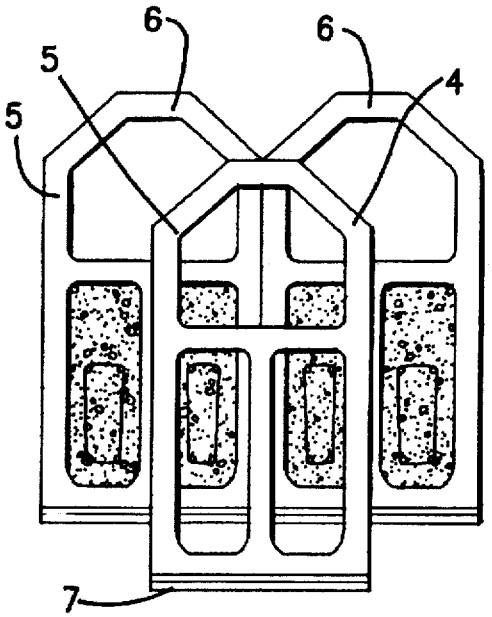

FIG. 10 is a view of several construction elements assembled one above the other. These elements are construction elements which have been obtained by division at the level of the transverse vertical partition of a "double" construction element.

Figure 11:
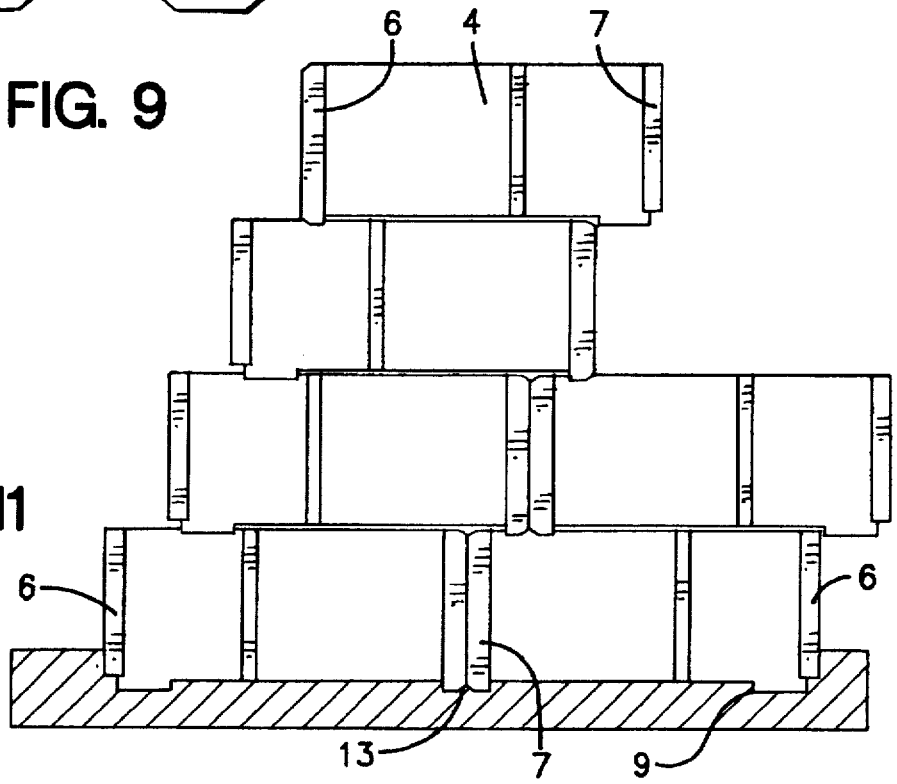

FIG. 11 is a view of several different construction elements assembled to build a retaining wall.

Figure 12:
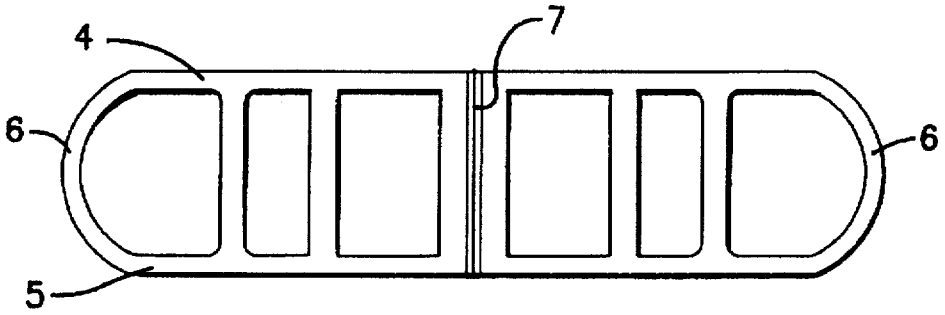

FIG. 12 is a plan view of another embodiment whose vertical connecting wall (between the parallel external lateral vertical walls) is of rounded shape.

Figure 13:
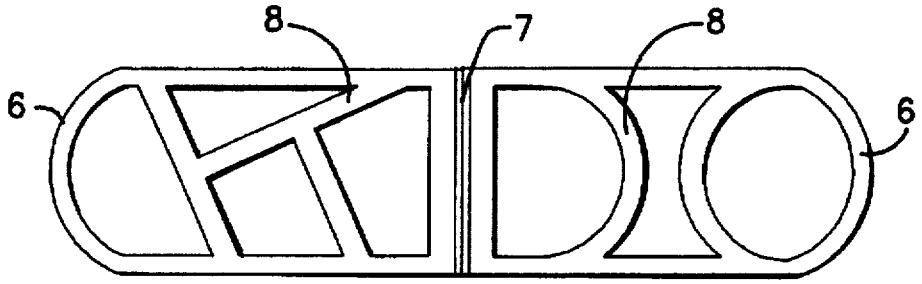

FIG. 13 is a plan view of another embodiment whose internal vertical walls delimit spaces of different sizes and shapes.

Figure 14:
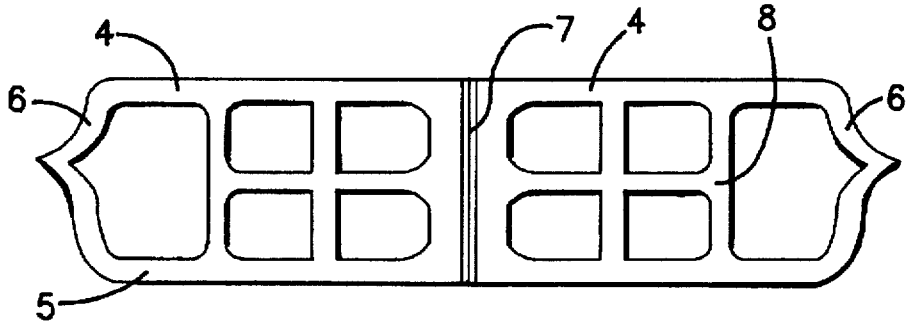

FIG. 14 is a plan view of another embodiment whose vertical connecting wall (between the parallel external lateral vertical walls) is in the shape of a point directed outwardly of the shell.

Figure 15:
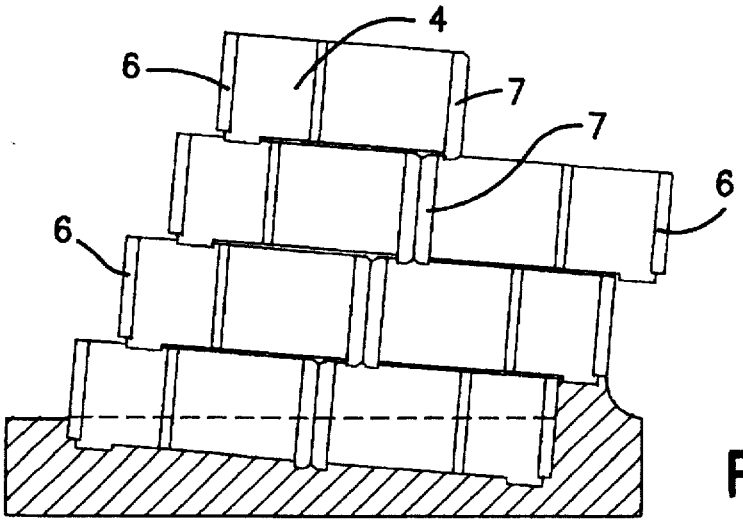

FIG. 15 is a view of the assembly of different construction elements, from the side and whose first construction element forms an angle with the plane of the ground.

Figure 16:
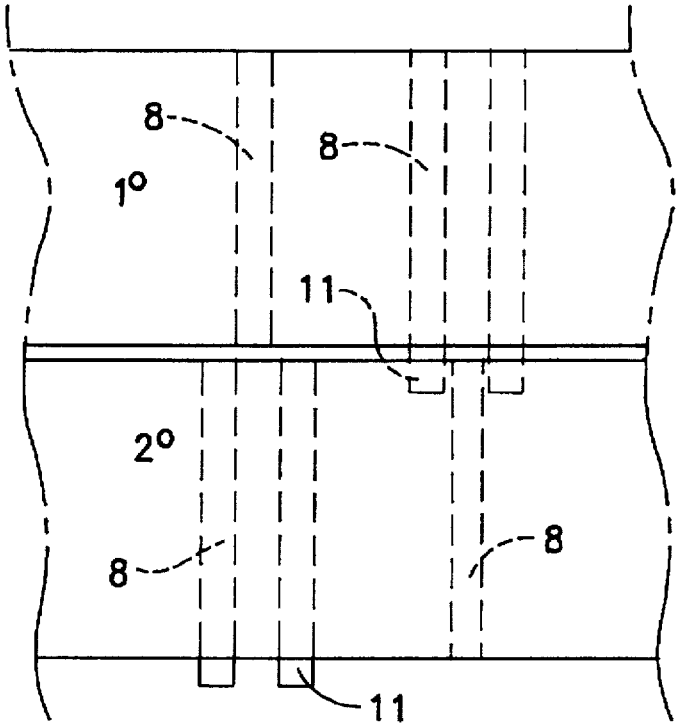

FIG. 16 shows a fragmentary side view of two superposed elements in a particular blocking position.

Figure 17:
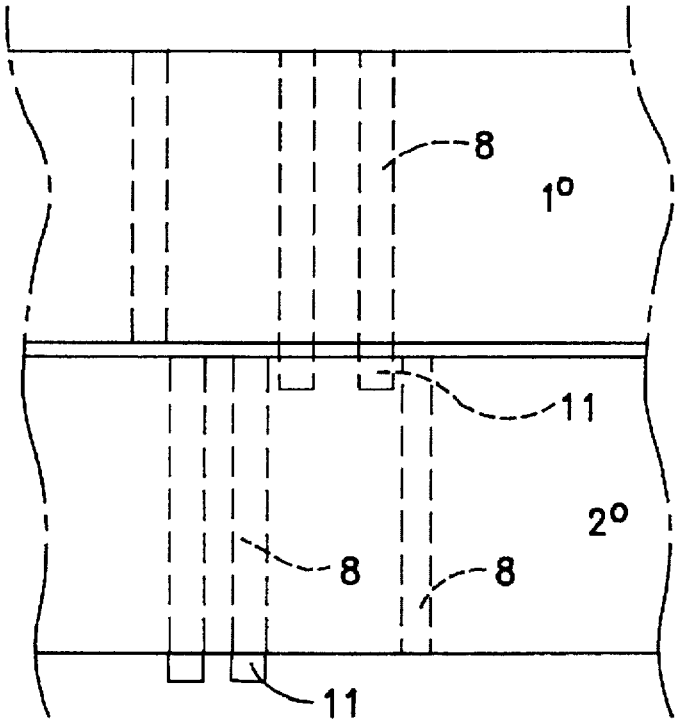
Figure 21:
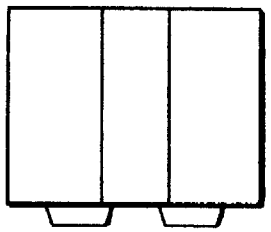
Figure 18:
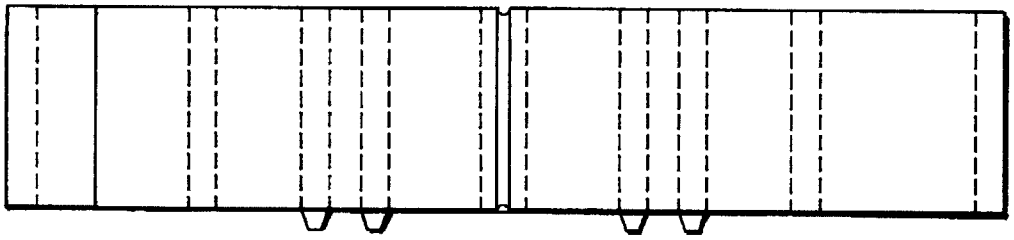
Figure 19:
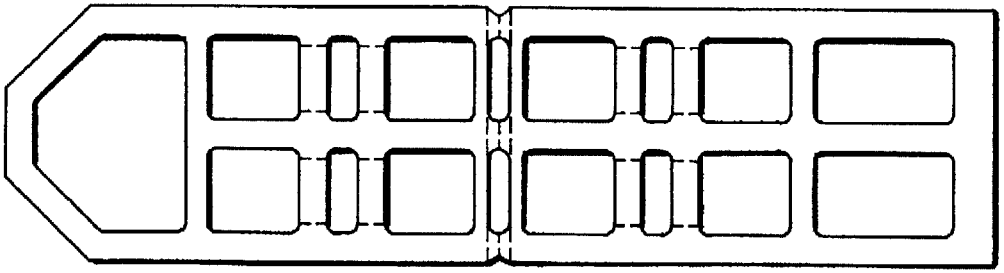
Figure 20:
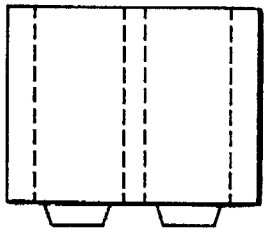

FIG. 17 shows a view identical to the preceding one in another particular blocking position.

FIGS. 18 to 21 show another embodiment of an element according to the invention, namely constituted by two blocks separated by a same vertical partition forming a pre-cutting groove.

Figure 22:
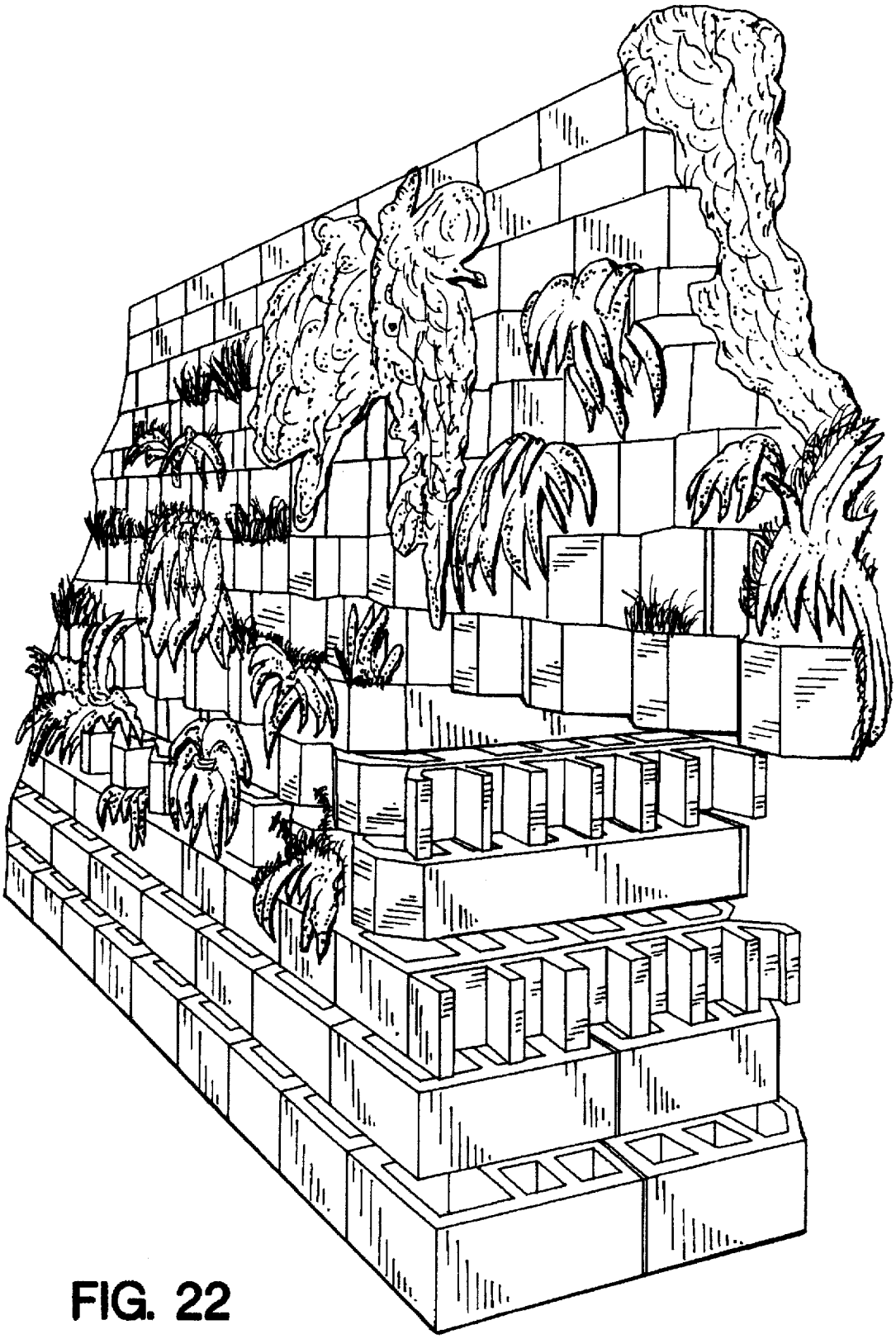

FIG. 22 is a perspective view of a retaining wall made from construction elements according to the invention in which certain elements in a first plane are sectioned so as better to show the internal structure of the wall.

DETAILED DESCRIPTION OF THE INVENTION

The retaining wall is the type adapted to be decorated with vegetation and constituted by construction elements 1, 2 dry mounted by interfitting the elements within each other and by superposition on each other.

Each element 1, 2 is parallelepipedal, constituted by an open-bottom shell 3 comprising two parallel external vertical walls 4, 5 interconnected at each of their ends by a vertical wall 6, 7 of any shape.

The open-bottom shell 3 is provided internally with several vertical walls 8 which delimit spaces of different sizes and shapes, the external lateral walls 4, 5 and 6, 7 are provided with recesses 9 so as to permit the elements to interfit within each other.

In the interior of the open-bottom shell 3 of the element 1, the lower edges 10 of the vertical walls 8 are provided with at least one coupling tab 11 which coacts with the upper vertical edges 12 of said vertical walls 8 of the lower element 2, which themselves are flat.

The vertical walls 6, 7 of any shape which connect the parallel external lateral vertical walls 4, 5 are also provided with at least one coupling tab or recess 9.

Figure 1:
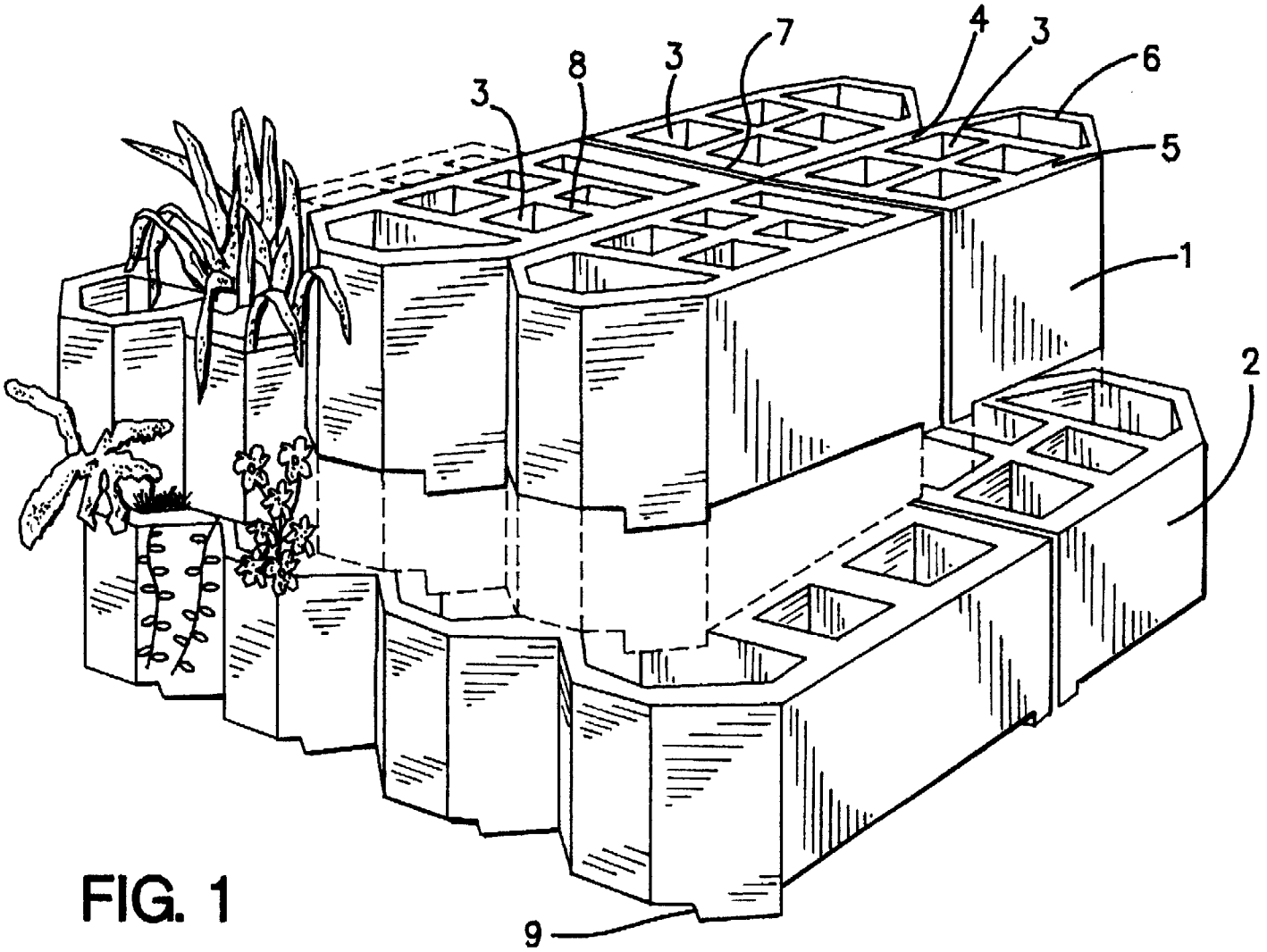
FIG. 1 is a perspective view of a retaining wall according to the invention.
Figure 3:
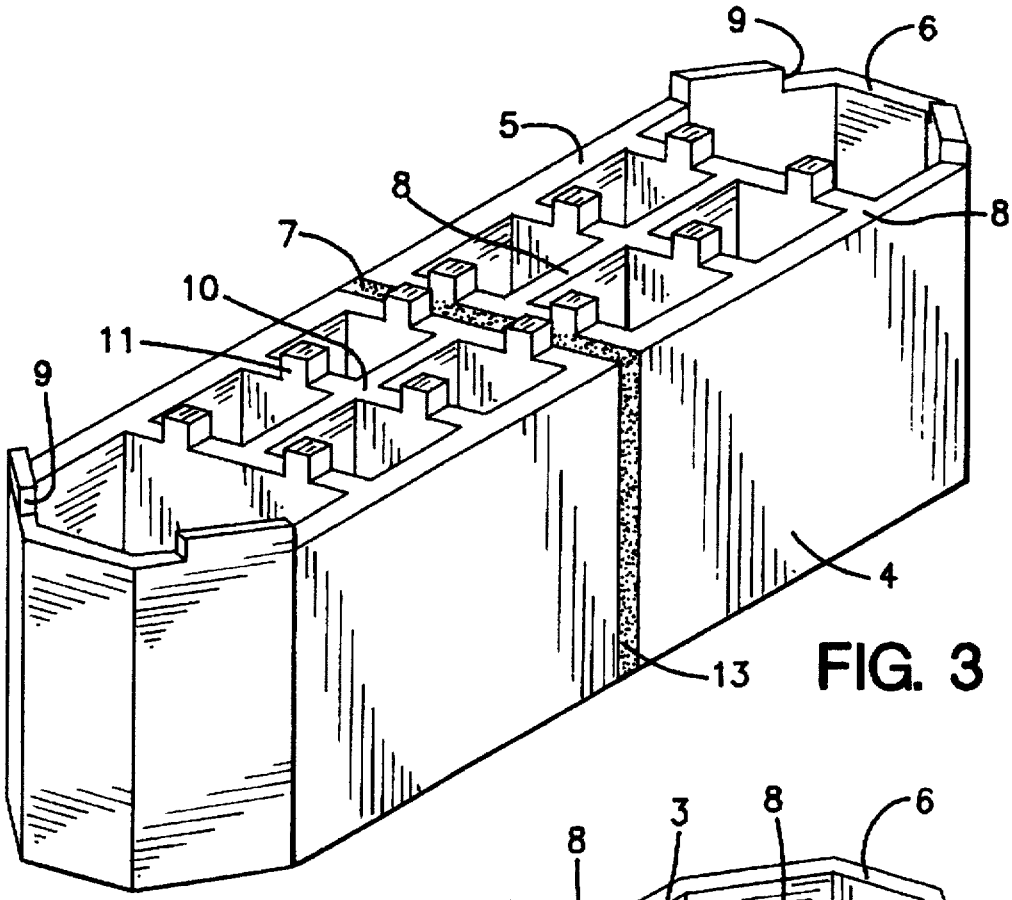
FIG. 3 is a view like FIG. 2, but in which the construction element is double and is seen from below so as to display the coupling tabs of the internal vertical walls of the shell and the transverse vertical partition common to the two construction elements.
Figure 2:
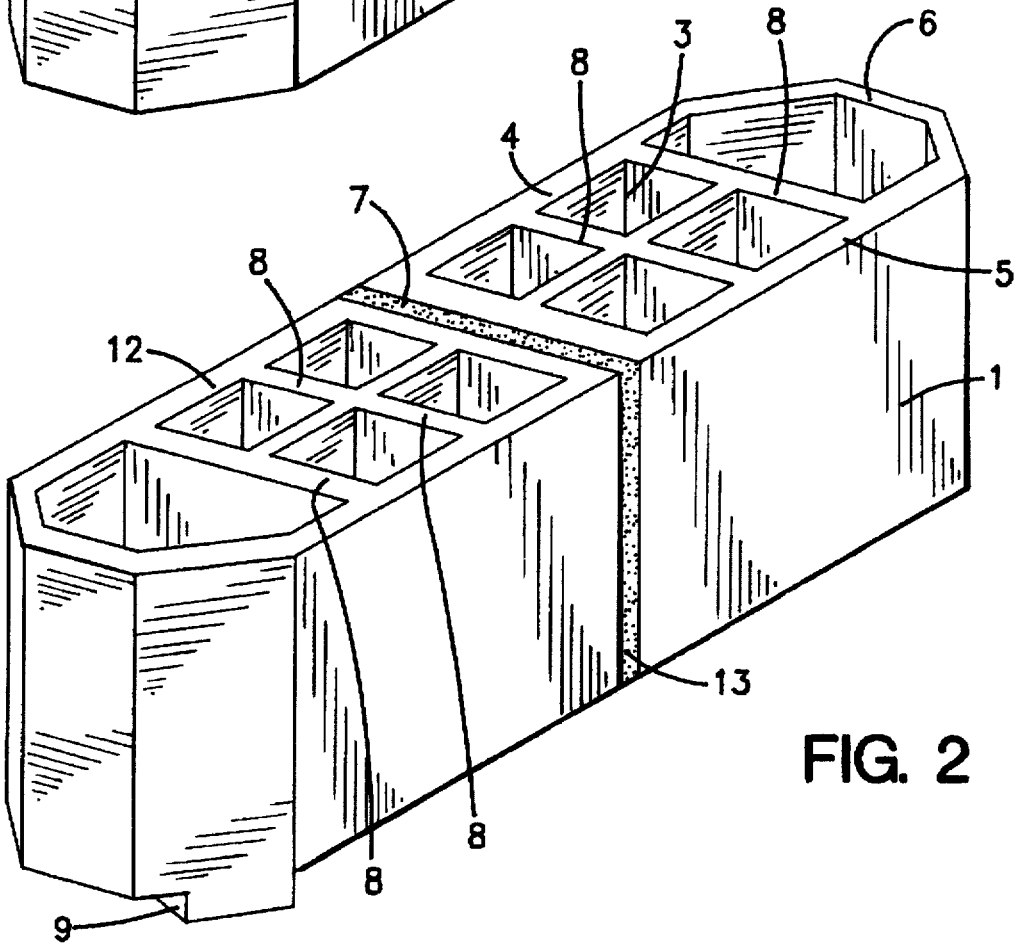
FIG. 2 is a perspective view of a construction element according to the invention, seen from above.
Figure 4:
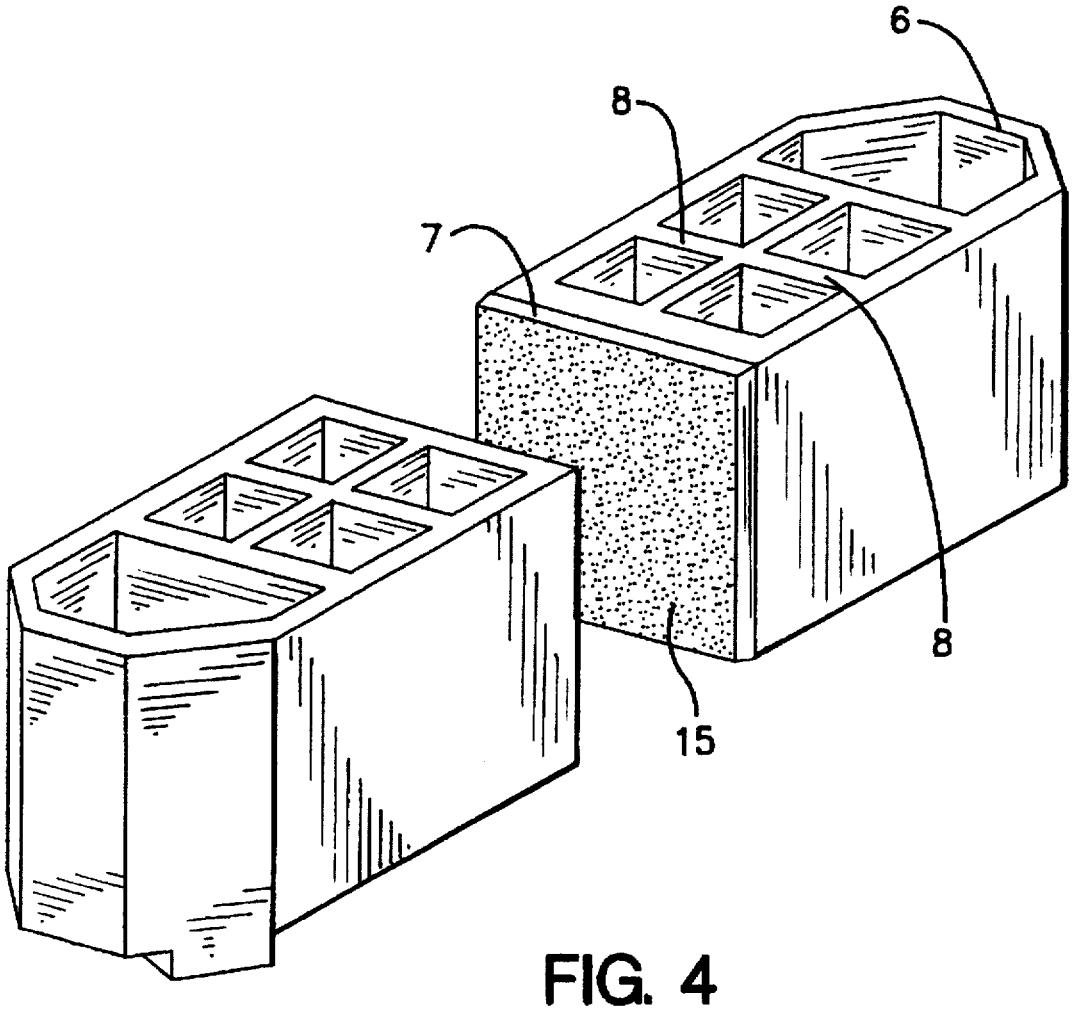
FIG. 4 is a perspective view of a double construction element showing the severable portion which permits dividing said element into two double construction elements.

According to one embodiment, the construction element 1, 2 is single, see FIGS. 4, 10.

According to other embodiments, the construction element is double. It is made of two construction elements interconnected by a same transverse vertical partition 7.

In the illustrated embodiments, each partition 7 which forms the plane of symmetry between the two construction elements is straight whilst the other wall 6 which connects the two parallel external lateral vertical walls has any shape according to the esthetic effect desired.

The vertical walls 6 of any shape, which connect the two parallel external lateral walls 4, 5 of a double element are oriented outwardly of said element.

The transverse vertical partition 7, common to the two construction elements forming the double construction element, comprises a severable portion 13.

This transverse vertical partition 7, common to the two construction elements, permits by means of a grinder, breaking at the level of the severable portion 13, the double element into two construction elements, see FIG. 4. The external surface of the transverse wall 7 is provided with a decorative facing 14, for example see FIG. 5, of vertical grooves, provided on this decorative facing 14.

The decorative facing 14 can be eliminated by grinding at certain breaking points to give the appearance of a "rough-hewn stone" surface 15.

Figure 5:
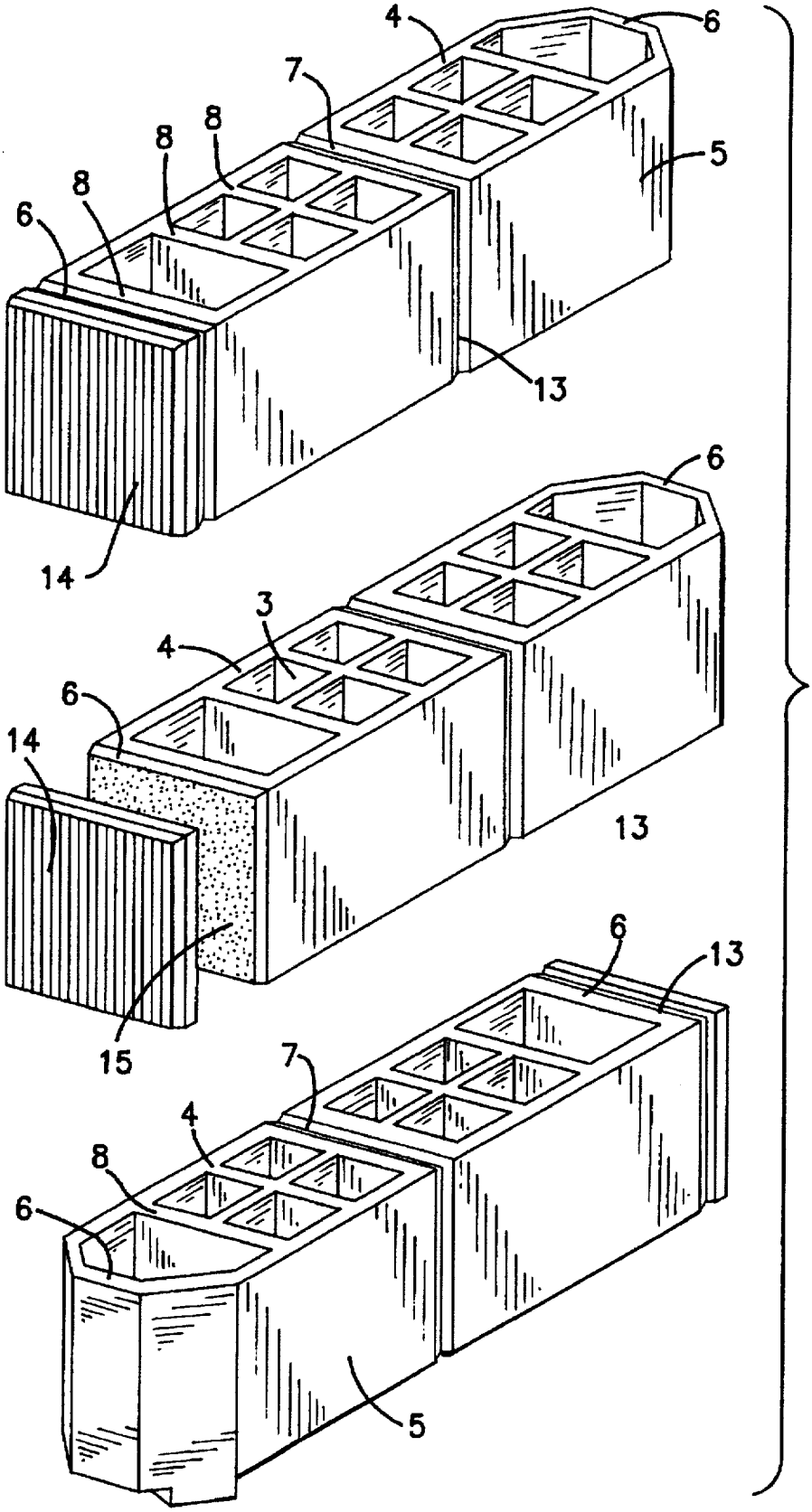
FIG. 5 is an exploded view of different construction elements assembled for a retaining wall.

Similarly, as shown in FIG. 5, the vertical partitions 6 of any shape, which connect the two parallel external lateral vertical walls 4, 5, comprise on their external surface a decorative facing 14. This same decorative facing 14 can be eliminated at breaking points 13 because it covers a "rough-hewn stone" surface 15.

Upon breaking the double construction element in two, there are obtained construction elements that can support vegetation, of smaller sizes which offer the advantage of several uses:

use in a wall of vegetation of small size, use in a region without pressing on the crest of a wall, finishing a wall of vegetation by a strip of "rough-hewn stone" style, producing a heavy wall with a surface having a "rough-hewn" stone appearance. According to this use, the wall can be either filled with dirt or concrete, according to the pressures.

The following figures show the different shapes which the external surfaces of the wall can have, as well as the different shapes which the internal vertical partitions 8 of the wall can have, thus forming spaces of various shapes.

In a same wall, it is possible to use a double construction element, then single or divided elements, see FIGS. 11, 15, or to reverse the forward and rear surfaces to modify the esthetic characteristics of the wall, see FIG. 5.

The construction elements are designed to be self-connecting, thanks to the coupling tabs 11.

Superposed on each other, these elements communicate through their spaces. The volume of the internal spaces is such that once the construction elements are superposed on each other, the roots leaving the upper shell penetrate the recesses of the lower construction element and continue through two or three elements.

In the case in which external pressures require a substantially greater strength, a portion of the spaces can receive concrete and be used as lost coffering.

In FIG. 5, the transverse vertical partition 7 forms a plane of vertical symmetry for the double construction element.

In this embodiment shown in FIG. 5, one of the two vertical walls of any shape 6 which connects the two parallel external vertical lateral walls 4, 5 of the construction element, delimits an empty space which registers with the first internal vertical wall 8 of the shell 3.

In another embodiment, shown in FIGS. 16 and 17, the distances separating the different internal vertical walls 8 are variable. Similarly, the provision on the lower edges 10 of said internal vertical walls 8, of coupling tabs 11 is not necessary, but is selected in an adequate manner.

This permits, in the case of FIG. 16, two adjacent tabs 11 to lock into one of the internal walls 8 of subjacent element 1.

In the case of FIG. 17, the two adjacent tabs 11 are inserted between two adjacent internal walls 8, of a subjacent element 1.

In these two FIGS. 16 and 17, the blocking is specifically longitudinal, but it is altogether possible to have the same arrangement to permit lateral blocking of the superposed and adjacent elements 1.

In FIG. 22, the retaining wall comprises numerous elements which each comprise two blocks connected together by a same transverse partition. The first block is a classical parallelepipedal whilst the second is a parallelepipedal whose two vertical angles which do not form the transverse partition have been truncated. Accordingly, as the element has the untruncated surface as is shown in the first three rows of elements, or the truncated surface as is shown in the rows of elements just above, the appearance of the wall can change. Similarly, if the elements are broken at the level of their transverse partition, they form two blocks which can present, if they are suitably oriented, "rough-hewn stone" surfaces.

In conclusion, with the same element there can be constructed walls having quite various external appearances.

REFERENCES 1, 2. Construction elements
3. Open-bottom shell.
4, 5. Parallel external lateral vertical walls
6, 7. Vertical walls of any shape
8. Internal vertical walls
9. Tabs or notches
10. Lower edges
11. Coupling tabs
12. Vertical upper edges of the shell
13. Severable portion
14. Decorative facing
15. "Rough-hewn stone" surface

I claim:

1. In a retaining wall adapted to be decorated with vegetation, and consisting of dry mounted construction elements interfitting within each other and superposed on each other, each element being of the parallelepipedal type and comprising an open bottom shell having two parallel external lateral vertical walls interconnected at each of their two ends by an external vertical end wall of any shape, said shell being provided internally with several internal vertical walls which delimit spaces of different sizes and shapes, the external vertical end walls being provided with notches so as to permit the construction elements to interfit within each other, the improvement wherein:

within the shell, delimited by the parallel external lateral vertical walls and the vertical end walls, lower edges of the internal vertical walls are provided with at least two coupling tabs which coact with vertical upper edges of a lower adjacent shell which, themselves, are flat;

the distance between two coupling tabs carried by the lower edges corresponds to the thickness of an internal vertical wall; and the distance between two internal vertical walls corresponds to the distance between two opposite surfaces of two adjacent coupling tabs, whereby there exists a plurality of possible positions between two adjacent and superposed construction elements.

2. Retaining wall according to claim 1, wherein the vertical end walls which connect the parallel external lateral vertical walls are provided with at least one coupling tab.

3. Retaining wall according to claim 1, wherein the construction element is double, formed of two construction elements interconnected by a same transverse vertical partition.

4. Retaining wall according to claim 3, wherein the vertical end walls, which connect the two parallel external lateral vertical walls, are outwardly oriented from the double construction element.

5. Retaining wall according to claim 3, wherein the transverse vertical partition, common to the two construction elements forming the double construction element, comprises a severable portion.

6. Retaining wall according to claim 5, wherein the transverse vertical partition, common to the two elements, once divided, exposes on its external surface for each construction element, a decorative facing.

7. Retaining wall according to claim 6, wherein the decorative facing is eliminated at certain breakage points to expose a "rough-hewn stone" surface.

8. Retaining wall according to claim 2, wherein the vertical end walls which connect the two parallel external lateral vertical walls expose on their external surface a decorative facing.

9. Retaining wall according to claim 8, wherein the decorative facing is eliminated at certain breakage points to expose a "rough-hewn stone" surface.

10. Retaining wall according to claim 3, wherein the transverse vertical partition forms a plane of vertical symmetry for the double construction element.

* * * * *